US006796233B2

(12) United States Patent
Brown et al.

(10) Patent No.: US 6,796,233 B2
(45) Date of Patent: Sep. 28, 2004

(54) PLATE CYLINDER WITH SPLINED SHELL

(75) Inventors: Kenneth Waldo Brown, Barrington, NH (US); Jared Paul Eaton, Stratham, NH (US); Lev Zlatin, Portsmouth, NH (US)

(73) Assignee: Heidelberger Druckmaschinen AG, Heidelberge (DE)

( * ) Notice: Subject to any disclaimer, the term of this patent is extended or adjusted under 35 U.S.C. 154(b) by 0 days.

(21) Appl. No.: 10/300,447

(22) Filed: Nov. 20, 2002

(65) Prior Publication Data

US 2004/0094054 A1 May 20, 2004

(51) Int. Cl.[7] ..... B41F 27/14

(52) U.S. Cl. ..... 101/382.1; 101/248; 101/378; 101/415.1; 101/DIG. 36; 492/30; 492/33; 492/45; 492/49

(58) Field of Search ..... 101/415.1, 248, 101/DIG. 36, 486, 375, 376, 378, 382.1, 372; 492/30, 33, 34, 40, 45, 49

(56) References Cited

U.S. PATENT DOCUMENTS 570,226 A * 10/1896 McAdams ..... 33/37
732,728 A * 7/1903 Forsyth ..... 492/40
4,207,815 A * 6/1980 Watanabe ..... 101/248
4,491,068 A * 1/1985 Stirbis ..... 101/40
5,069,127 A * 12/1991 Iijima et al. ..... 101/415.1
5,322,229 A * 6/1994 Imada ..... 242/419.5
5,451,198 A 9/1995 Lancaster ..... 492/48
6,553,908 B1 * 4/2003 Richards et al. ..... 101/248

FOREIGN PATENT DOCUMENTS

| | | |
|---|---|---|
| DE | 10135506 | 2/2002 |
| EP | 1193059 | 4/2002 |
| FR | 2176205 | 10/1973 |
| JP | 06226949 | 8/1994 |
| JP | 2000954 | 6/1998 |

* cited by examiner

*Primary Examiner*—Daniel J. Colilla
*Assistant Examiner*—Jill E. Culler
(74) *Attorney, Agent, or Firm*—Davidson, Davidson & Kappel, LLC

(57) ABSTRACT

A plate cylinder has a cylinder body having a cylinder body outer surface for a first image to be printed and a first end, and a shell having an inner surface circumferentially disposed about the first end and having a gap for holding a printing plate, the shell being axially and circumferentially moveable with respect to the first end and having a shell outer surface for a second image to be printed, the inner surface having at least one projection directed inwardly, the gap extending into the projection.

15 Claims, 5 Drawing Sheets

PLATE CYLINDER WITH SPLINED SHELL

BACKGROUND INFORMATION

The present invention relates generally to printing presses and more particularly to plate cylinders for printing presses.

Japanese Patent Application No. 2000-954 A shows a printing plate cylinder with a cylinder body and a shell mounted to a reduced diameter portion of the cylinder body for independent movement of the shell in order to adjust the lateral and circumferential register of a printing plate mounted to the shell with respect to the printing plate mounted on the cylinder body on the other side of the printing plate cylinder. The shell has a uniform thickness.

BRIEF SUMMARY OF THE INVENTION

Commonly-owned European Patent Application No. 1 913 059 discloses a plate cylinder in which shells are movable with respect to a cylinder body using axially-extending arms gripping the underside of the shells, and corresponds to U.S. patent application Ser. No. 09/675,494, which is hereby incorporated by reference herein.

Commonly-owned German Patent Application No. 101 35 506 discloses a plate cylinder in which a shell is axially movable but circumferentially fixed with respect to a cylinder body, and corresponds to U.S. patent application Ser. No. 09/627,639, which is hereby incorporated by reference herein.

An object of the present invention is to provide a shell with space for a plate clamping device while minimizing loss of stiffness of the cylinder body. Another alternate or additional object of the present invention is to provide a splined shell connection with a cylinder body in which circumferential register is permissible.

The present invention thus provides a plate cylinder comprising a cylinder body having a cylinder body outer surface for a first image to be printed and a first end, and a shell having an inner surface circumferentially disposed about the first end and having a gap for holding a printing plate, the shell being axially moveable with respect to the first end and having a shell outer surface for a second image to be printed, the inner surface having at least one projection directed inwardly, the gap extending into the projection.

Since gaps for holding printing plates often require a substantial lock-up mechanism, the present invention permits sufficient space for the gap in the projection, while advantageously still permitting a thin shell thickness in other locations.

Preferably, the shell is at least partially circumferentially movable with respect to the cylinder body.

The at least one projection may include a plurality of projections. If more than one printing plate is supported by the shell, a gap may be located in each projection. Preferably, the projections are spaced symmetrically in the circumferential direction.

The cylinder body preferably has at least one outwardly projecting protrusion, and most preferably more than one of such protrusions. Preferably, the projection of the shell fits between two protrusions of the cylinder body. The protrusions may define a space into which the projection fits, the space preferably being wider than the projection, so that the shell is circumferentially movable with respect to the cylinder body.

The cylinder body may have a second end, with a second shell supported on the second end in a similar manner to the first shell.

A lock-up device is preferably located in the gap.

The present invention also provides a plate cylinder comprising a cylinder body having cylinder body outer surface for a first image to be printed and a first end with at least one outwardly-projecting protrusion having a first side and second side defining a space therebetween, and a shell having an inner surface circumferentially disposed about the first end and having a gap for holding a printing plate, the shell being axially moveable with respect to the first end and having a shell outer surface for a second image to be printed, the inner surface having at least one projection directed inwardly to fit into the space, the space being wider than the projection so as to permit circumferential movement of the shell with respect to the first end.

Preferably, a first and a second protrusion are provided, with the first side on the first protrusion and the second side on the second.

BRIEF DESCRIPTION OF THE DRAWINGS

Exemplary embodiments of the present invention will be further clarified with respect to the following drawings in which.

DETAILED DESCRIPTION

Figure 1:
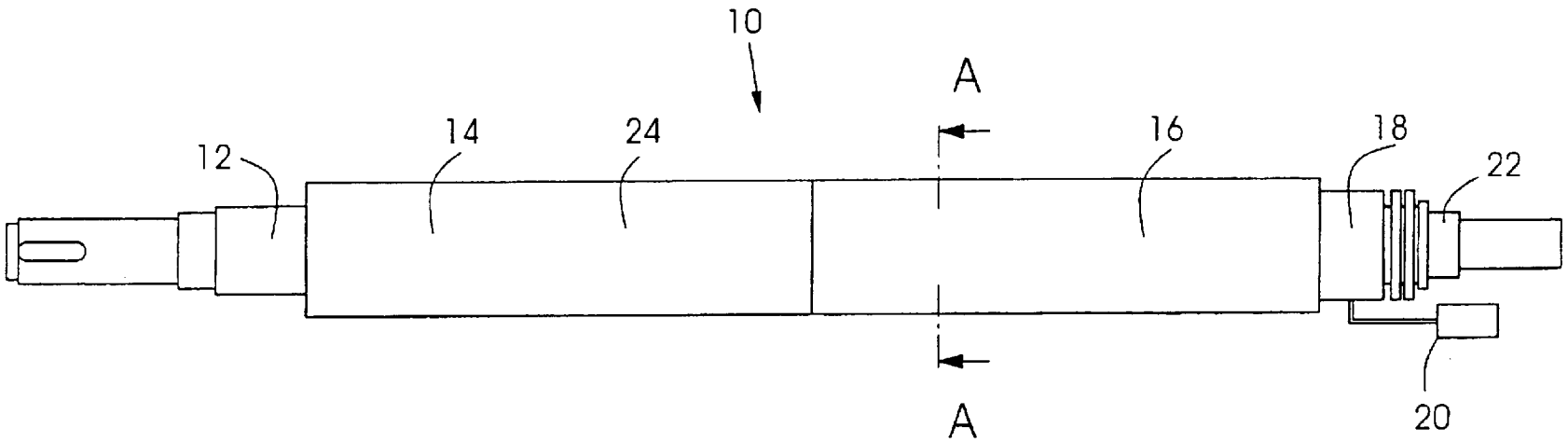
FIG. 1 shows a plate cylinder according to the present invention with the cylinder body supporting one image and the shell supporting the other.

FIG. 1 shows a plate cylinder 10 having a cylinder body 14 with ends 12 and 22. A shell 16 is placed about the cylinder body 14 at the side toward end 22. Cylinder body 14 has an image area 24 on an outer surface, as does shell 16. The image areas have a similar circumference. Shell 16 may be both axially and, to a limited extent, circumferentially registered with respect to a cylinder body outer surface or image area 24, for example through a registration device 20 which contacts a reduced circumference area 18 of shell 16.

Figure 2:
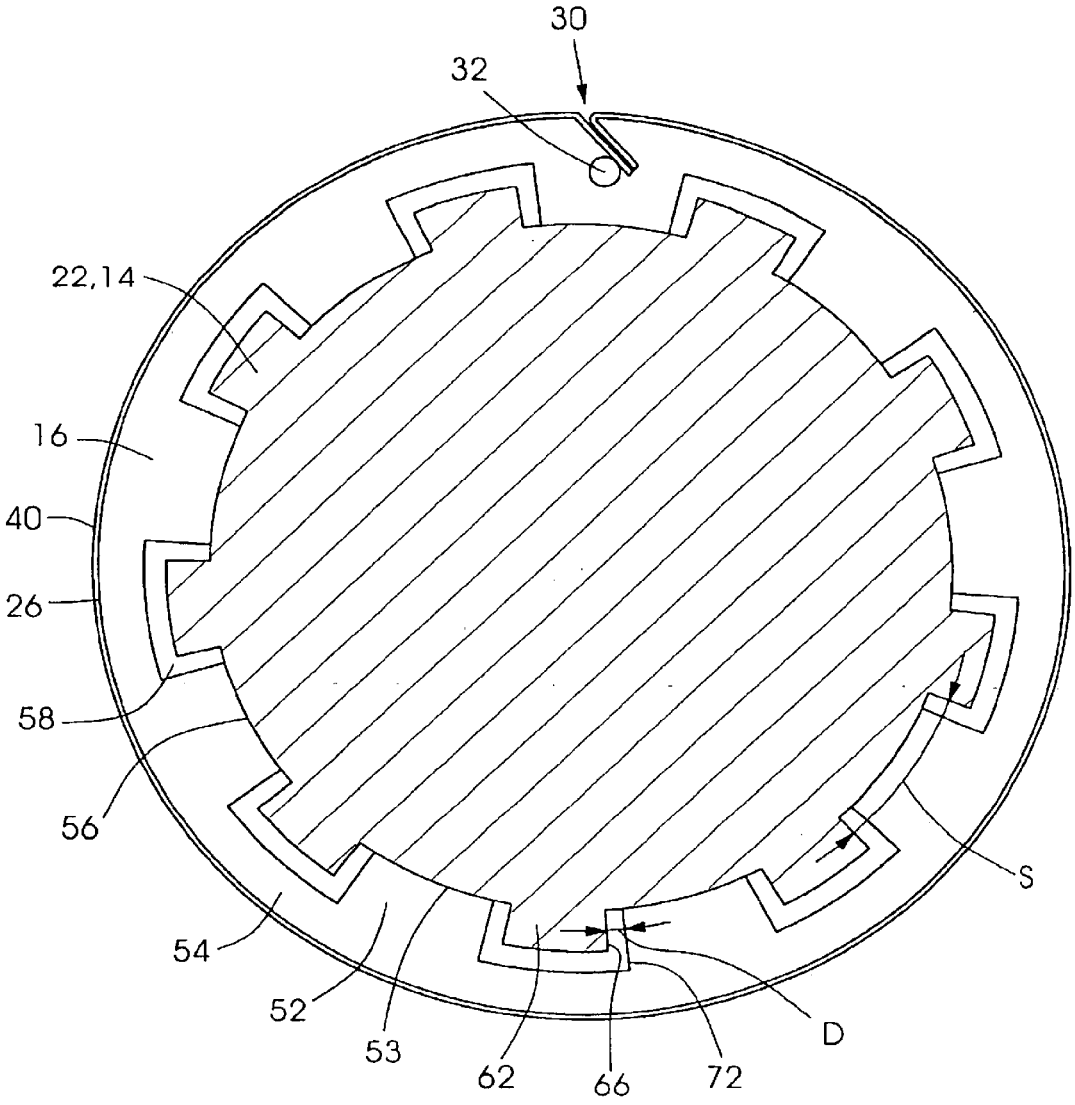
FIG. 2 shows a cross-section of the plate cylinder of FIG. 1.

FIG. 2 shows a cross section of the plate cylinder 10 through location A—A of FIG. 1. Shell 16 is disposed circumferentially about end 22 of cylinder body 14. The shell 16 has an inner surface 56 disposed about end 22. End 22 has outwardly-projecting protrusions 62 defining a space S between the protrusions 62.

Inner surface 56 of shell 16 has inwardly-projecting projections 52 to fit into spaces S, the projections defining voids 58. Space S is wider than projection 52 so that a distance D may result between a side 66 of the protrusion 62 a side 72 of the projection 52 and permit circumferential movement of the shell 16 with respect to end 22.

Contact between inner surface 56 and end 22 occurs at contact area 53, which may be provided with a friction-reducing substance, such as PTFE, to aid in axial and circumferential relative motion.

An axially-extending gap 30 is located on an outer surface 26 of shell 16, for holding an image-carrying plate 40, for example a lithographic printing plate. A lock-up device 32 can fasten the plate to the shell 16. Image area 24 of cylinder 14 (FIG. 1) also has an axially-extending gap and a lock-up device for another plate that is spaced axially with respect to plate 40.

The shell 16 thus has reduced thickness areas 54 between projections 52, to accommodate protrusions 62, providing a splined nature of the cylinder body. The splined nature of the shell 16 and body 62 also increases stiffness, which can aid in reducing streaking.

Figure 3:
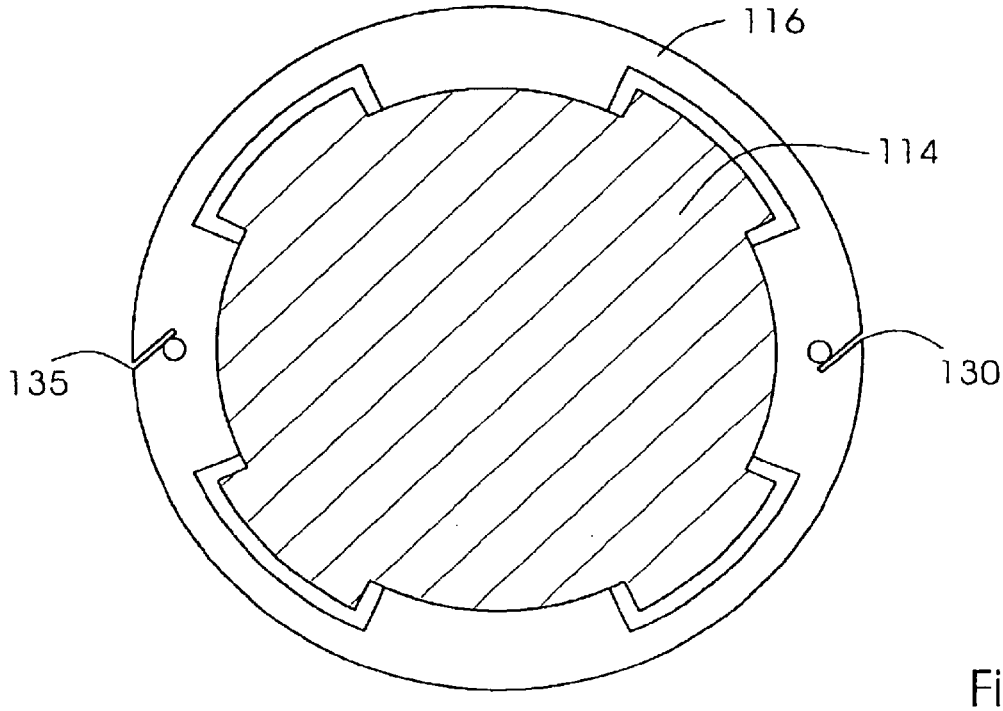
FIGS. 3, 4 and 5 show alternate shell and cylinder body end configurations.

FIG. 3 shows an alternate embodiment of the present invention in which splined shell 116 has four projections, and cylinder body 114 has four protrusions. Two axially extending gaps 130, 135 for printing plates may be provided, so as to define a two-around plate cylinder.

Figure 4:
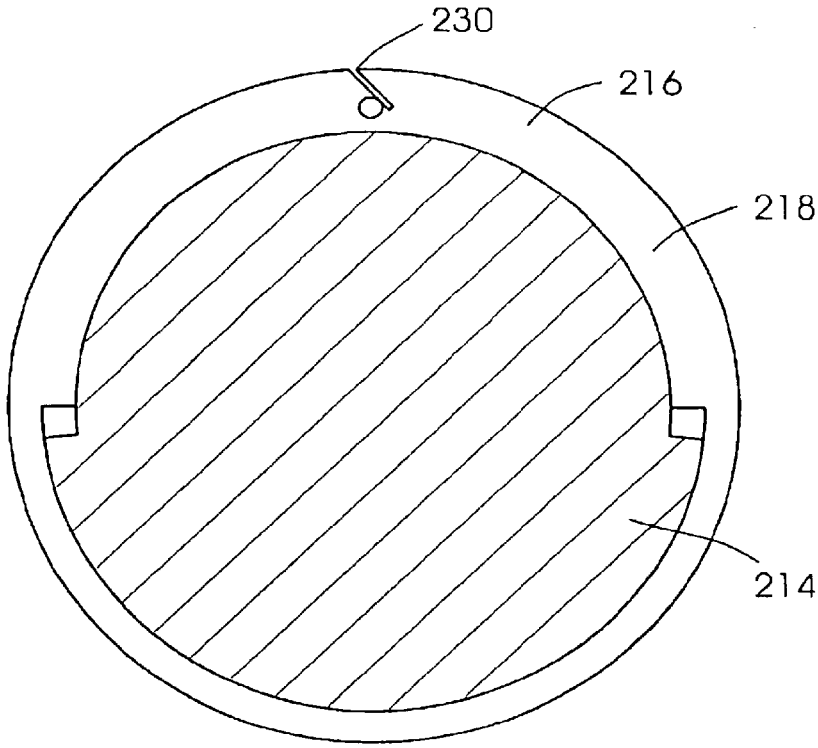

FIG. 4 shows another alternate embodiment with cylinder body 214 having a single protrusion and shell 216 having a single projection 218. A gap 230 may be provided extending into projection 218.

Figure 5:
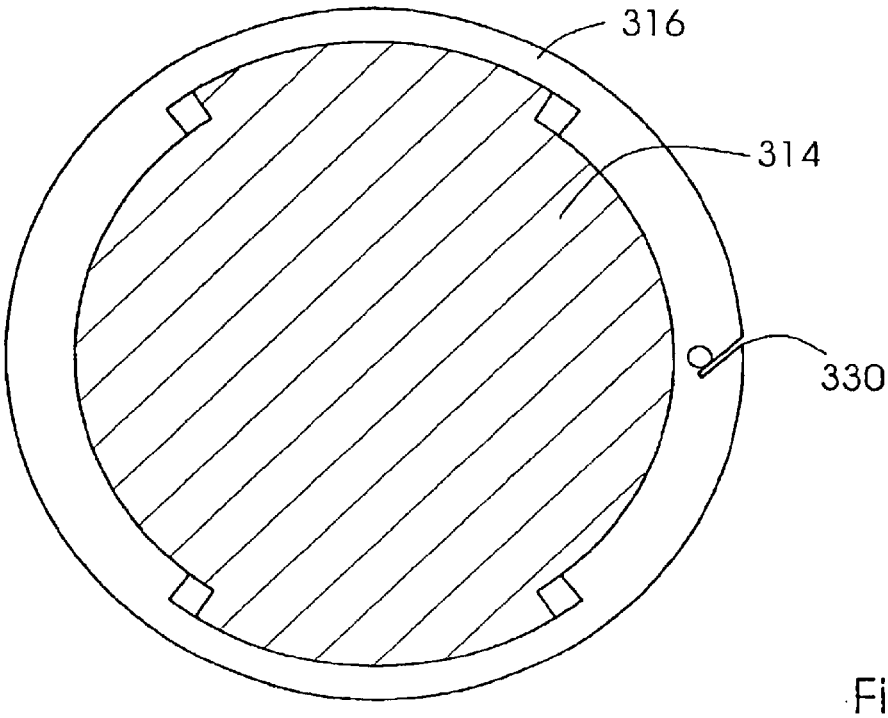

FIG. 5 shows yet another alternate embodiment in which the shell 316 includes a gap 330 in one of two projections, which interleave with two protrusions of cylinder body 314.

Figure 6:
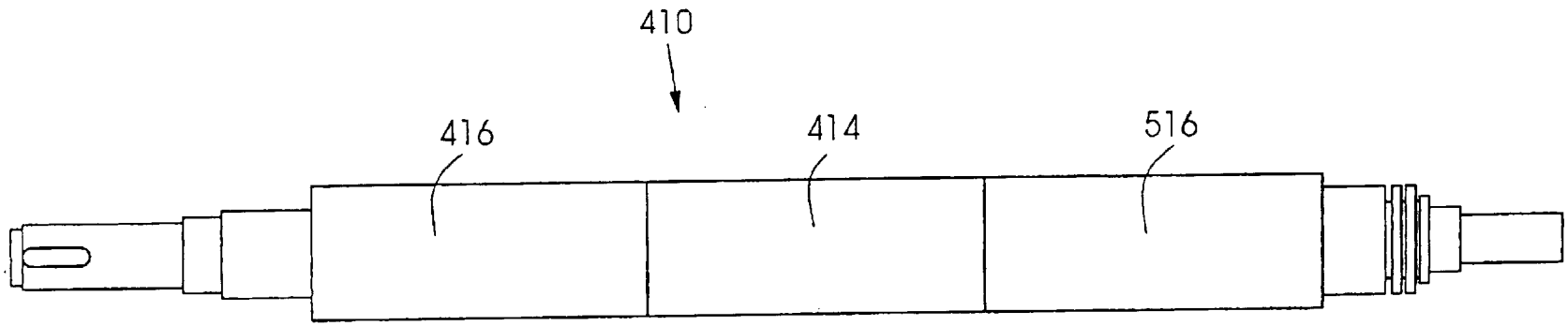
FIG. 6 shows a three-image plate cylinder with two shells.

In FIG. 6, two splined shells 416, 516 sandwich a center image area 414 of a cylinder 410, so that three or more axially-spaced image areas may be provided.

Figure 7:
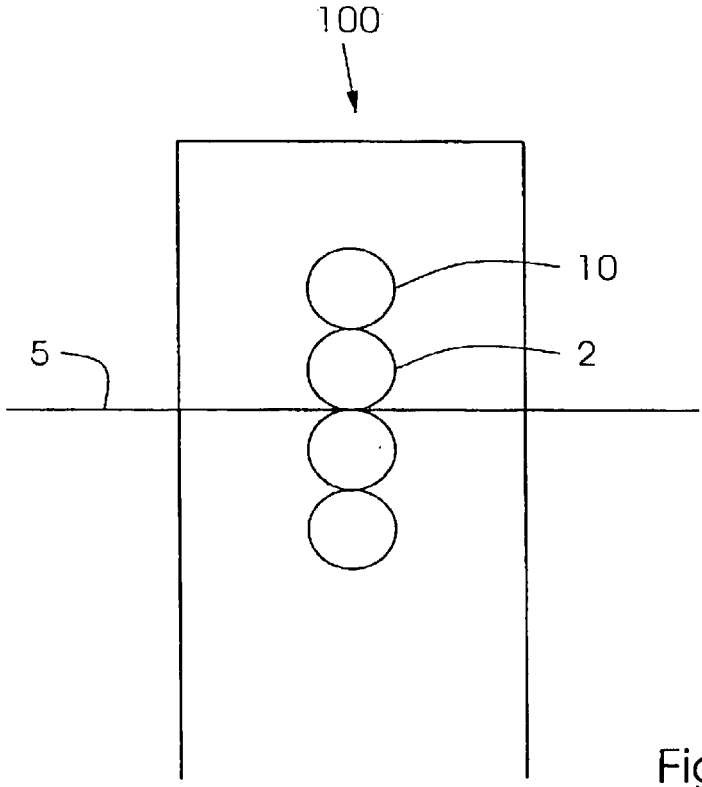
FIG. 7 shows an exemplary offset lithographic printing press of the present invention.

FIG. 7 shows the use of the plate cylinder 10 in an exemplary offset lithographic printing press 100 having a blanket cylinder 2 and a web 5. Once the plates are fastened to plate cylinder 10, the shell 16 and cylinder body 14 can be rotated together during a print run and register can be adjusted axially or circumferentially.

List of Numbers

2 Blanket cylinder
5 Web
10 Plate cylinder
12 End
14 Cylinder body
16 Shell
18 Reduced circumference area
20 Registration device
22 End
26 Surface
30 Gap
32 Lock-up device
40 Plate
52 Projection
53 Contact area
54 Reduced thickness area
56 Inner surface
58 Voids
62 Protrusion
66 Side
72 Side
100 Printing press
114 Body
116 Shell
130 Gap
135 Gap
214 Body
216 Shell
218 Projection
230 Gap
314 Body
316 Shell
330 Gap
410 Cylinder
414 Body
416 Shell
516 Shells

What is claimed is:

1. A plate cylinder comprising:

a cylinder body having a cylinder body outer surface for a first image to be printed and a first end, and a shell having an inner surface circumferentially disposed about the first end and having a gap for holding a printing plate, the shell being axially moveable with respect to the first end and having a shell outer surface for a second image to be printed, the inner surface having at least one projection directed inwardly, the gap extending into the projection.

2. The cylinder as recited in claim 1 wherein the shell is circumferentially movable with respect to the cylinder body.

3. The cylinder as recited in claim 1 wherein the at least one projection includes a plurality of projections.

4. The cylinder as recited in claim 1 wherein the shell has an additional gap spaced circumferentially with respect to the gap.

5. The cylinder as recited in claim 4 wherein the wherein the at least one projection includes a first projection and a second projection, the gap being located in the first projection and the additional gap in the second projection.

6. The cylinder as recited in claim 3 wherein the plurality of projections are spaced symmetrically in the circumferential direction.

7. The cylinder as recited in claim 1 wherein the cylinder body has at least one outwardly projecting protrusion.

8. The cylinder as recited in claim 7 wherein the at least one protrusion includes a plurality of protrusions.

9. The cylinder as recited in claim 8 wherein the projection of the shell fits between two of the plurality of protrusions.

10. The cylinder as recited in claim 9 wherein the two protrusions define a space for the projection, the space being wider than the projection.

11. The cylinder as recited in claim 1 wherein the cylinder body has a second end and further comprising a second shell supported on the second end.

12. The cylinder as recited in claim 1 further comprising a lock-up device located in the gap.

13. A plate cylinder comprising:

a cylinder body having cylinder body outer surface for a first image to be printed and a first end with at least one outwardly-projecting protrusion having a first side and second side defining a space therebetween, and a shell having an inner surface circumferentially disposed about the first end and having a gap for holding a printing plate, the shell being axially moveable with respect to the first end and having a shell outer surface for a second image to be printed, the inner surface having at least one projection directed inwardly to fit into the space, the space being wider than the projection so as to permit circumferential movement of the shell with respect to the first end.

14. The cylinder as recited in claim 13 wherein the at least one protrusion includes a first and a second protrusion, with the first side on the first protrusion and the second side on the second protrusion.

15. An offset lithographic printing press comprising:

a plate cylinder having a cylinder body having a cylinder body outer surface for a first image to be printed and a first end, and a shell having an inner surface circumferentially disposed about the first end and having a gap for holding a printing plate, the shell being axially moveable with respect to the first end and having a shell outer surface for a second image to be printed, the inner surface having at least one projection directed inwardly, the gap extending into the projection; and a blanket cylinder contacting the plate cylinder.

* * * * *